United States Patent [19]

Bolza-Schünemann

[11] 3,952,651

[45] Apr. 27, 1976

[54] SHEET FEEDING APPARATUS FOR PRINTING MACHINES

[75] Inventor: Hans Bernhard Bolza-Schünemann, Wurzburg, Germany

[73] Assignee: Koenig & Bauer Aktiengesellschaft, Wurzburg, Germany

[22] Filed: Mar. 4, 1974

[21] Appl. No.: 447,698

[30] Foreign Application Priority Data

Mar. 16, 1973 Germany ..... 2313150

[52] U.S. Cl. ..... 101/242; 101/232; 271/246

[51] Int. Cl.[2] ..... B41F 21/04

[58] Field of Search ..... 101/232, 239, 241, 242; 271/234–237, 243, 246

[56] References Cited

UNITED STATES PATENTS

| | | | |
|---|---|---|---|
| 877,851 | 1/1908 | Martindale | 101/242 |
| 1,046,190 | 12/1912 | Huddleston | 101/242 |
| 2,857,161 | 10/1958 | Kist | 271/237 |
| 3,001,788 | 9/1961 | Vandeman | 271/237 |
| 3,015,486 | 1/1962 | Weidenhammer | 271/236 |
| 3,140,780 | 7/1964 | Richert et al. | 271/197 |
| 3,263,992 | 8/1966 | Schrempp | 271/246 |
| 3,542,360 | 11/1970 | Carey | 271/236 |
| 3,698,706 | 10/1972 | Mihojevich et al. | 271/197 |
| 3,730,514 | 6/1973 | Burkhardt | 271/197 |
| 3,823,937 | 7/1974 | Hirafiji | 271/107 |

*Primary Examiner*—Edgar S. Burr
*Assistant Examiner*—William Pieprz
*Attorney, Agent, or Firm*—Jones, Tullar & Cooper

[57] ABSTRACT

In a sheet feeder for rotary printing presses having a feed table, a side register lay, and front register lays, a first push type conveyor is positioned in advance of the front lays and a second push type conveyor is positioned between the front lays and the continuously rotating impression cylinder of the printing press. These first and second conveyors cooperate to sequentially grip and convey sheets of paper and the like to the press's impression cylinder which is equipped with register lays and grippers. The feed table's front register lays are arranged to lift the first registered sheet thus permitting a succeeding sheet to advance beneath the raised sheet.

4 Claims, 5 Drawing Figures

SHEET FEEDING APPARATUS FOR PRINTING MACHINES

BACKGROUND OF THE INVENTION

The invention relates generally to a device for feeding sheets to printing presses from a feed table to a continuously rotating impression cylinder of the printing press.

Devices of this kind are known generally. Pregripprs are known which, while rotating like stop cylinders or with a reciprocating swinging motion, grip every sheet registered against a feed table's front register lays and pull-type side register lay by means of grippers, accelerate the sheet to peripherical speed of the cylinder, and transfer it to grippers in the impression cylinder. Although such devices are operating with satisfaction, they are expensive and tend to bend the sheet according to the type of their design, this bending being detrimental particularly in relation to cardboard printing.

Known feeding devices of a different type clamp the registered sheet between feed-rolls and convey it on a nearly rectilinear way or path at an accelerated speed against stops on the impression cylinder, whereupon the cylinder grippers close. Such drive rolls have also been replaced with suction tapes with forward and backward motion. Such feeding devices push the leading forward of the sheet (push conveyors), whereas the devices mentioned first pull the sheets (pull conveyors). Advantages of the push conveyors are that they are less expensive and that they transfer the sheets to the cylinder grippers nearly free of curvature. It is a disadvantage however, of the push conveyors that the sheet driving means, — either clamping rolls or suction tapes — lie in front of the front register lays; i.e. between the front register lays and side register lays contrary to the first mentioned group of sheet feeding devices in which the pull conveyor is between the feed table front lays and the impression cylinder. The clamping or suction conveying device must therefore have finished sheet conveyance of a first sheet before the next sheet comes into its range of action. The path to the front register lays remains blocked up to that instant; as far as drive rolls are concerned, sheet conveyance must not be initiated before the trailing edge of the preceding sheet has cleared the clamping rolls. The period of time available for registering between one sheet and the next one is shorter than that available with rotating pre-grippers. Therefore, the conveying capacity of registered sheets is even lower with such push conveyors than with pull conveyors.

SUMMARY OF THE INVENTION

It is an object of the present invention to provide a sheet feeding device which is of simple, and hence economical design, which feeds the sheet without curvature, and which operates at high speeds. According to the invention, this object is realized by the fact that at least two push conveyors effect conveyance, a first such conveyor being situated in front of, or in advance of, the front register lay, and the second conveyor being situated behind the front register lays; i.e. between the front register lays and the impression cylinder.

According to the present invention, a first sheet registered against the feed table's front register lays and side register lays can be gripped by a first push conveyor, and can be conveyed with moderate acceleration from a position of rest slowly along the feed table. When the leading edge of the sheet has covered a certain distance, it reaches a second push conveyor located between the front register lays and the impression cylinder. Sheet conveyance of the first sheet is thus transferred to the second push conveyor located between the front register lays and cylinder. The first push conveyor, charged before, is switched over into a position in which it no longer affects the first sheet, and the front register lays, which have dropped below the level of the feed table to allow passage of the first sheet, are raised back up to elevate the trailing edge of the first sheet thus enabling a next sheet to enter the front register lays, passing this first push conveyor and sliding thereunder. The second push conveyor conveys the first sheet in an orthodox manner at a somewhat increased speed than the speed of rotation of the impression cylinder against stops in the impression cylinder. When the sheet has been gripped by the cylinder grippers, the second push conveyor is also switched over into a position in which it does not affect the sheet, thus preparing it for conveyance of the next sheet.

The device according to the preset invention differs in an advantageous manner from orthodox sheet-feeding devices. Expensive swinging or rotating pre-grippers are replaced with pairs of clamping rolls as discussed above or with simple suction tapes which are guided in a plane over at least two suction boxes. In a further development of the invention, reverse motion of the clamping rolls or suction tapes results in being nonessential. Such clamping rolls or suction tapes rotate like stop-cylinders and come to a state of rest only for short periods, so that twice as much time is available for starting and braking of the push conveyors and thus of the sheets to be conveyed. The fact that the sheet feeding device according to the invention is divided in suction boxes or pairs of clamping rolls in front of and behind the front register lays enables a very early conveyance of every next sheet against the front register lays, which has been unknown with prior push conveyors, since previously the way to the front register lays has been obstructed by clamping rolls or a suction bar until the complete sheet conveyance is terminated; i.e. the sheet must be delivered to the impression cylinder grippers, so that the registering period of time is very short.

BRIEF DESCRIPTION OF THE DRAWINGS

A sheet-feeding device according to the invention is hereinafter described by way of example, with reference to the accompanying drawings, in which.

DESCRIPTION OF A PREFERRED EMBODIMENT

Figure 1:
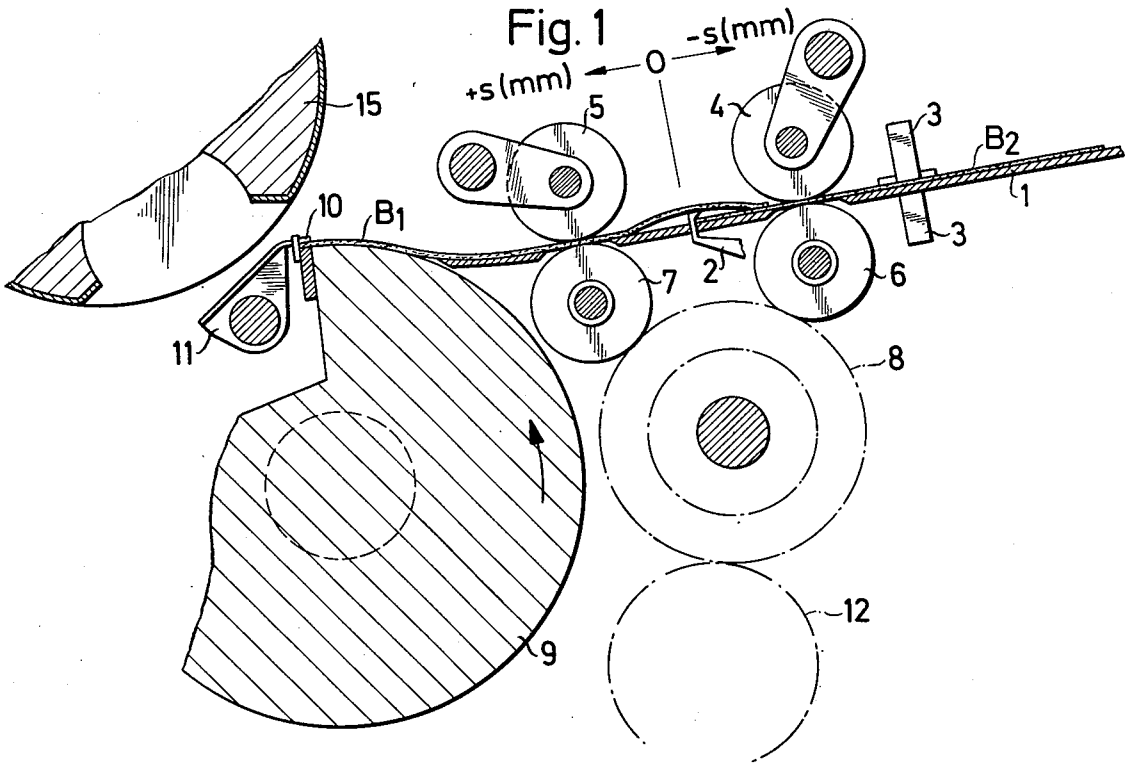
FIG. 1 shows a side view of the device with clamping rolls.

Sheets B1, B2 come overlapping off a feed table 1 against the raised front register lays 2, as may be seen in FIG. 1. After sheet registering at lays 2 and by means of the side registering pull-type lay 3, the first pair of clamping rolls 4, 6 closes in position of rest. After opening or lowering of the front register lays 2, the slow revolution of the clamping rolls 6, 4 and thus the moderate sheet conveyance of sheet B1 begins. After a certain period of time, the leading edge of the first sheet B1 has reached the second pair of clamping rolls 5,7 which are driven synchroneously with the first pair of clamping rolls 6,4 by a driving gear 8, common to the first and second pair of clamping rolls. The second pair of clamping rolls 5,7 now executes sheet conveyance, while the first pair of clamping rolls 4,6 opens and front register lays 2 raise. Thus in a novel manner the way or path to front register lays 2 becomes free for the next sheet B2 which slides under the traling edge of sheet B1, as may be seen in FIG. 1, whereas sheet feeding of sheet B1 is not yet terminated, i.e. the leading edge of sheet B1 has not yet reached gripper 11 of an impression cylinder 9. The pair of clamping rolls 5,7 conveys sheets B1 at accelerating speed until the sheet touches front register lays 10 in impression cylinder 9 at a somewhat higher speed than corresponds to the peripherical speed of impression cylinder 9. Now grippers 11 close, and subsequently the second pair of clamping rolls 5,7 opens. The speed of drive gear 8, and thus the speed of the pairs of clamping rolls 4,6 and 5,7 is reduced to zero, momentarily by stop gear 12 and then drive gear 8 starts again whereupon the first pair of clamping rolls 4,6 begins conveyance of the next sheet.

Figure 2:
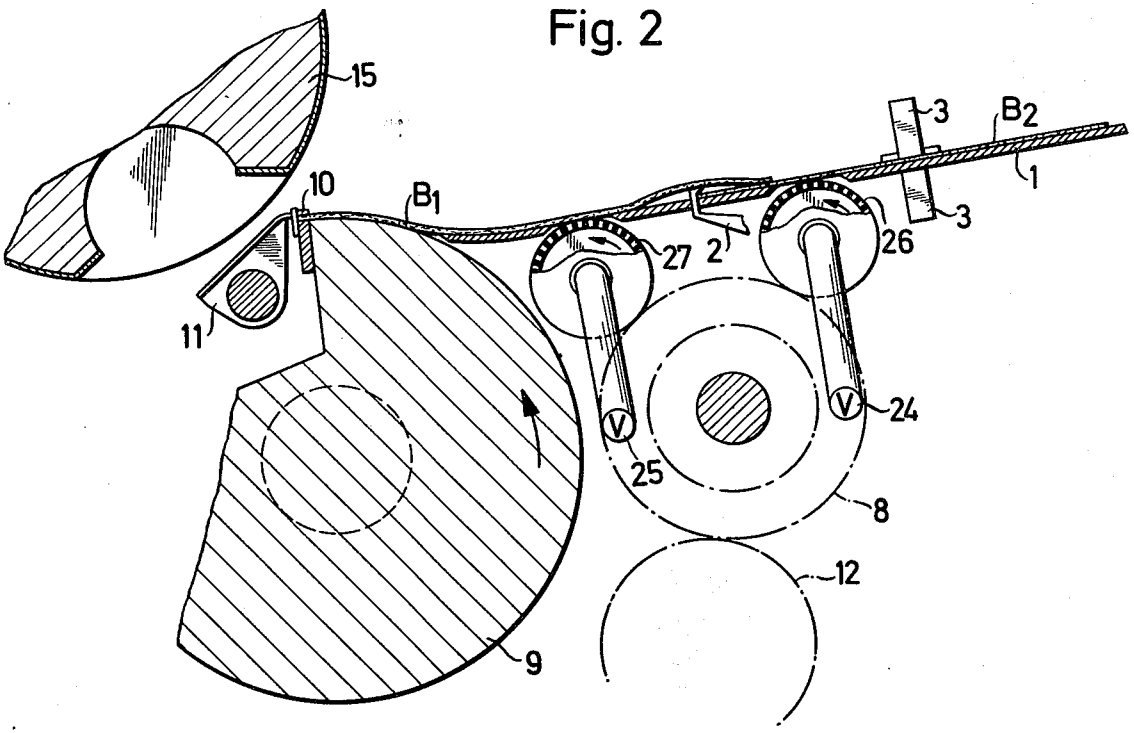
FIG. 2 shows a side view of the device with suction rolls.

FIG. 2 shows an assembly generally similar to FIG. 1, with the pairs of clamping rolls 4 to 7 being, however, replaced here with suction rolls such as are used for example for sheet braking in the pile deliveries of printing presses. Suction rolls 26 in front of, and 27 behind front register lays 2 are driven in common by driving gear 8 and stop gear 12 which rotate like stop-cylinders to convert uniform rotary motion to syncronous, non-uniform rotary motion such as by means of Geneva motion gears or gears of other known types. The clamping rolls 4 and 5 as shown in FIG. 1, which move with rhythmic motion, are replaced with air valves 24 and 25 which first switch on suction roll 26 for the initial movement of the first sheet B1 and then switch on suction roll 27 as soon as the leading edge of sheet B1 has reached suction roll 27. The suction is then disconnected from suction roll 26, and suction roll 27 alone executes sheet conveyance for sheet B1. As suction roll 26 has been cut off, the next sheet B2 can be fed from the feed table against front register lays 2, which have risen from below, as seen in FIG. 2, with sheet B2 passing over suction roll 26 and underneath sheet B1 conveyed off above, whose conveyance by suction roll 27 has not yet terminated.

Figure 3:
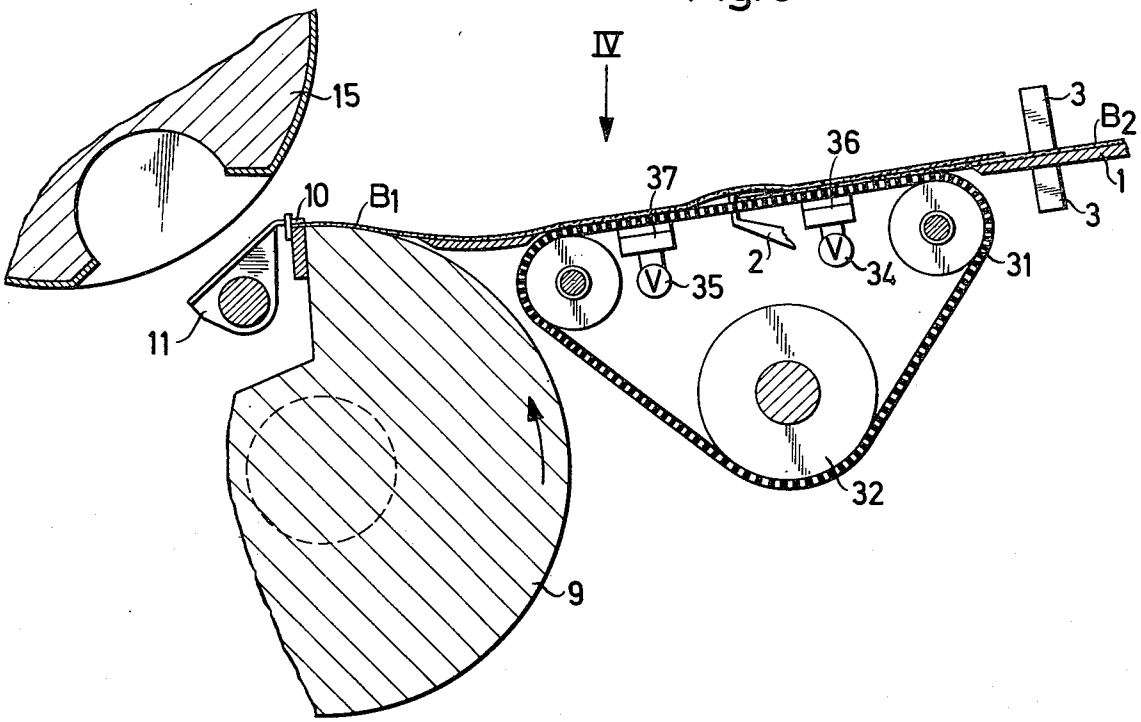
FIG. 3 shows a side view of the device with suction tapes.

FIG. 3 shows another variant of FIGS. 1 and 2. The first sheet B1 is shown as arriving at front register lays 10 and gripper 11 of impression cylinder 9. Sheet conveyance and acceleration are executed here by a set of perforated suction tapes 31 which are guided over two suction boxes 36 and 37 with individual air control valves 34 and 35. Driving of tapes 31 is done by a drum and shaft indicated at 32 rotating like a stop cylinder, which can execute several revolutions before being at rest for a short period of time. At the instant shown in FIG. 3, suction channel 37 is operating, i.e. the sheet B1 is kept there by suction and thus is conveyed. The following sheet B2 has arrived at the front register lays 2 and between sheet B1 and suction tape 31 with vacuum to suction box 36 being cut off, so that sheet registering can begin, though conveyance of the preceding sheet B1 against impression cylinders 9 is not yet terminated.

The great advantage of spared feeding time is obvious. If there were only suction box 36, it would still have to convey — instead of suction box 37 — sheet B1. Consequently the leading edge of the following sheet B2 could not yet contact front register lays 2. The following sheet B2 could be, at most, on the level of pull-type side lay 3, i.e. not yet in the range of action of suction box 36, which would still be conveying sheet B1. Thus, this shows clearly how much the time for registering is reduced, or alternatively, how much time is distributed with the novel device according to the invention by using push conveyance both in front of and behind the line of the front register lays 2 for intermittent conveying of the sheets.

Figure 4:
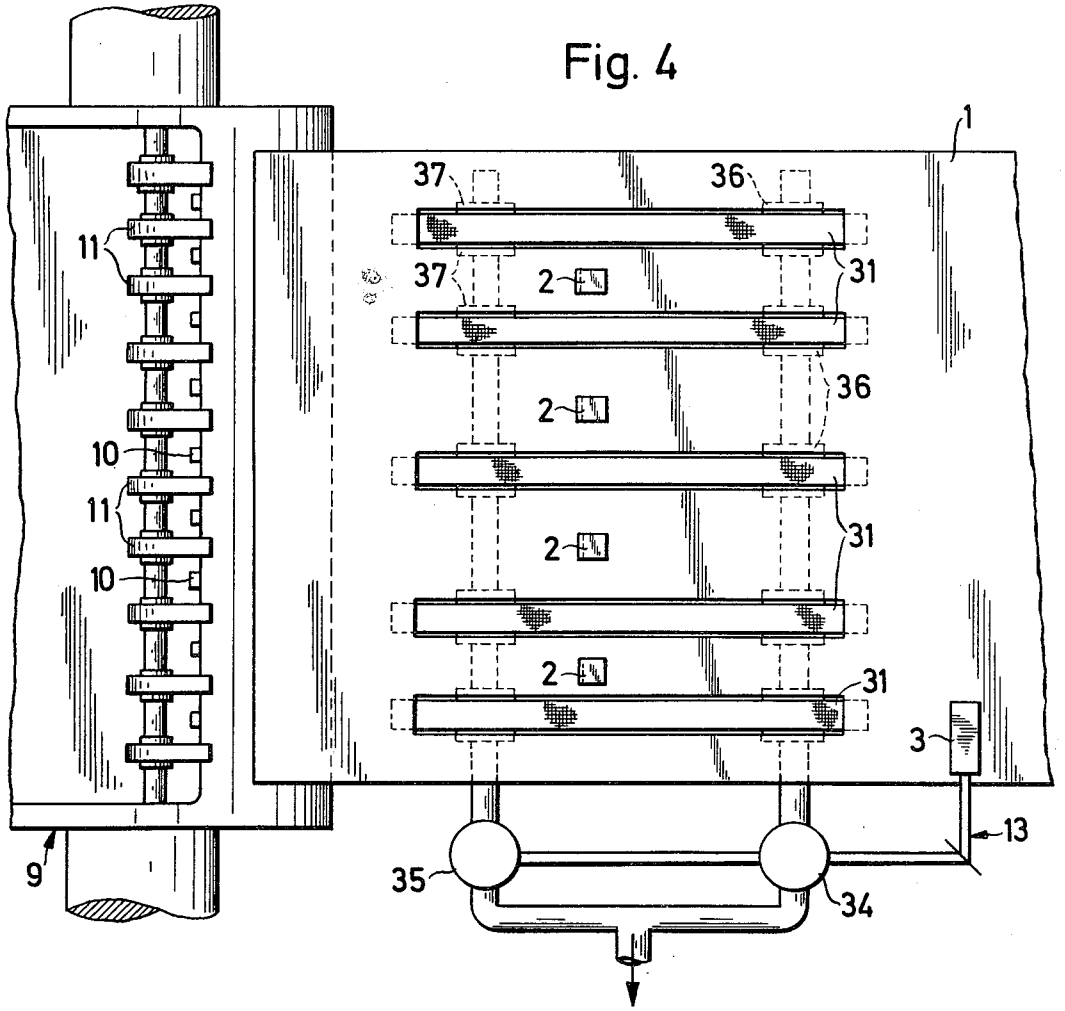
FIG. 4 shows a plan view on FIG. 3.

FIG. 4 shows a plan view with feed table 1, front register lays 2 raising from below, pull-type side register lay 3, air valve 34 for suction box 36 in front or in advance of the front register lays 2 and air valve 35 with suction boxes 37 behind front register lays 2. Number 31 refers to five suction tapes. The sheets are conveyed against front register lays 10 in impression cylinder 9, whereupon grippers 11 close. A side shaft 13 rotating with one single revolution per sheet drives pull-type side lay 3 and controls also air valves 34, 35 by any suitable means such as cams and the like carried on shaft 13.

Figure 5:
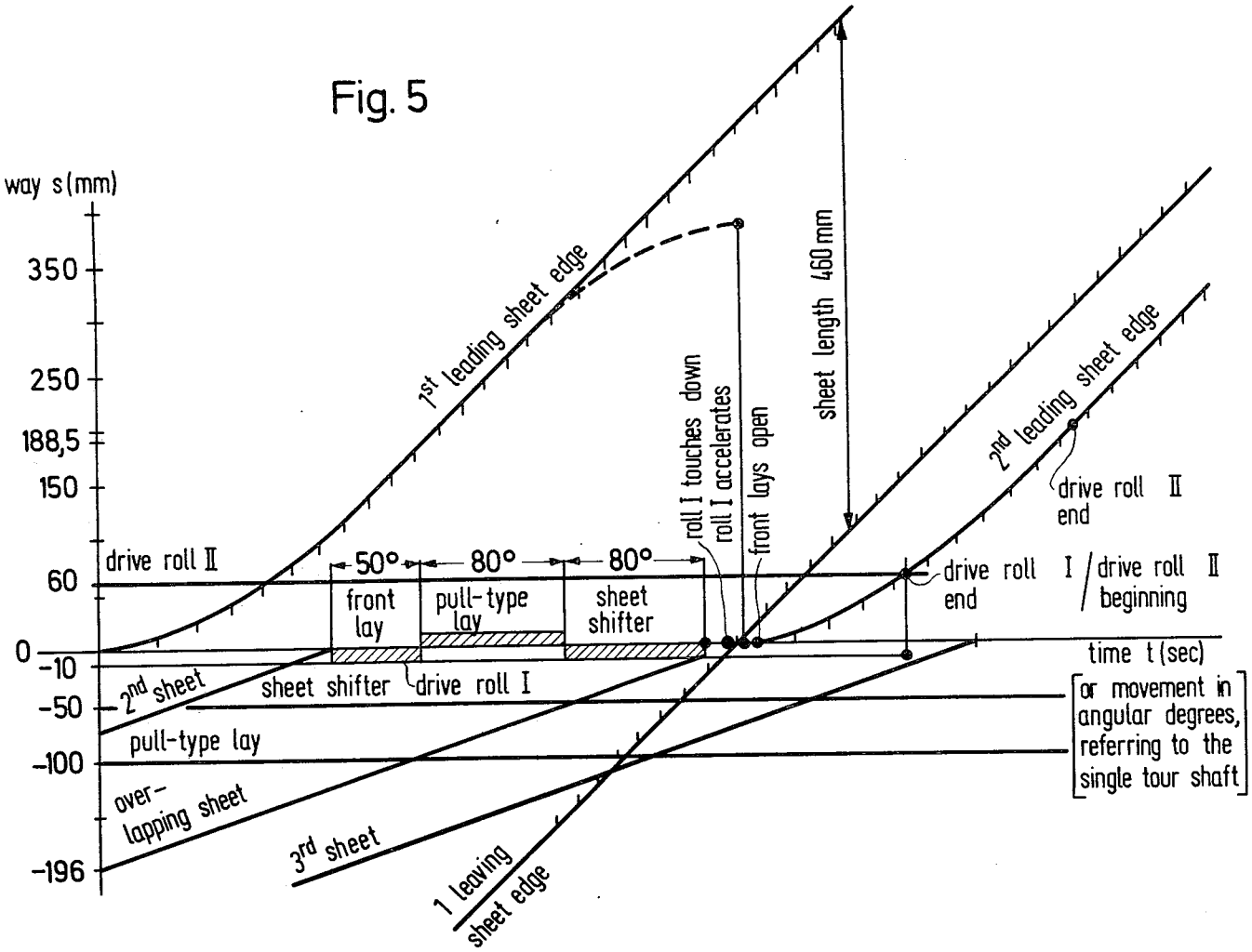
FIG. 5 shows a diagram of distance covered and time.

FIG. 5 shows a diagram of distance covered and time from which the chronological process of sheet conveyance can be seen. For obtaining highest output, a side registering is used — as known with pull conveyors — which works with overlapping sheets. In this case the periods of time available for registering against front register lays and side register lays as well as for sheet acceleration, will be of optimal length.

The push conveyors can also move forward and backward and have a resting position for taking up the sheets, as is already known. Known speed transmission gears like wheel crank gears, Geneva motion gears, cam controlled differential gears, or the like serve for driving the push conveyors.

What I claim is:

1. Sheet feeding apparatus for printing presses for sequentially feeding sheets to the constantly rotating impression cylinder of a printing press, the impression cylinder having front stops and sheet grippers, said sheet feeding apparatus including in combination:

a sheet feeding table having front register lays, said front register lays being vertically reciprocatable cyclically with rotation of the impression cylinder to register sheets thereat;

a first push type conveying means positioned adjacent the feed table and in advance of the feed table's front register lays, said first push type conveyor being operable intermittently to advance a first one of said sheets from its registered position against the front register lays along the feed table toward the impression cylinder; and a second push type conveying means positioned adjacent the feed table and between the front register lays and the impression cylinder, said second push type conveying means receiving said first one of said sheets from said first conveying means upon release of said first one of said sheets from said first conveying means, said second conveying means intermittently conveying said first one of said sheets along the feed table to the sheet grippers of the impression cylinder at a speed higher than the peripheral speed of the impression cylinder, said second conveying means releasing said first one of said sheets to the impression cylinder grippers as said first conveying means advances a second one of said sheets from its registered position against said front register lays toward said second conveyor, said front register lays being positioned beneath said feed table to lift a trailing edge of said first sheet to permit said second sheet to move thereunder, whereby the first and second conveying means sequentially feed sheets along the feed table to the impression cylinder.

2. Sheet feeding device according to claim 1 wherein each of the push type conveying means are pairs of clamping rolls which intermittently come to rest and open.

3. Sheet feeding device according to claim 1 wherein each of the push type conveying means are suction rolls, said suction rolls having drive means causing them to intermittently come to rest and means for intermittently supplying each suction roll with vacuum.

4. Sheet feeding device according to claim 1 wherein each of the push type conveying means comprises a suction box which intermittently but at different instants are supplied with vacuum and over which a suction tape is guided which intermittently comes to rest.

* * * * *